US007134395B2

(12) United States Patent
Riley et al.

(10) Patent No.: US 7,134,395 B2
(45) Date of Patent: Nov. 14, 2006

(54) ACID INKJET IMAGING OF LITHOGRAPHIC PRINTING PLATES

(75) Inventors: Donald Riley, Wake Forrest, NC (US); Teresa Baker, Louisburg, NC (US)

(73) Assignee: Southern Lithoplate, Inc., Youngsville, NC (US)

( * ) Notice: Subject to any disclaimer, the term of this patent is extended or adjusted under 35 U.S.C. 154(b) by 186 days.

(21) Appl. No.: 10/760,904

(22) Filed: Jan. 20, 2004

(65) Prior Publication Data

US 2005/0155506 A1 Jul. 21, 2005

(51) Int. Cl.
*B41N 3/00* (2006.01)

(52) U.S. Cl. ..... 101/465; 101/454; 101/463.1

(58) Field of Classification Search ..... None
See application file for complete search history.

(56) References Cited

U.S. PATENT DOCUMENTS

| | | | | |
|---|---|---|---|---|
| 4,448,647 | A * | 5/1984 | Gillich et al. | 205/50 |
| 5,275,689 | A | 1/1994 | Felten et al. | 156/628 |
| 5,520,986 | A * | 5/1996 | Wang | 428/131 |
| 5,641,608 | A * | 6/1997 | Grunwald et al. | 430/302 |
| 5,738,013 | A | 4/1998 | Kellett | 101/463 |
| 5,763,134 | A | 6/1998 | Busman et al. | 430/157 |
| 6,040,108 | A * | 3/2000 | Schadeli et al. | 430/200 |
| 6,389,970 | B1 * | 5/2002 | Tashiro et al. | 101/462 |
| 6,472,054 | B1 | 10/2002 | Aurenty et al. | 428/195 |
| 2003/0007052 | A1 | 1/2003 | Huang et al. | 347/101 |
| 2003/0030689 | A1 | 2/2003 | Hasimoto et al. | 347/20 |
| 2004/0038152 | A1 | 2/2004 | Goodin et al. | 430/302 |

* cited by examiner

*Primary Examiner*—Andrew H. Hirshfeld
*Assistant Examiner*—Jill E. Culler
(74) *Attorney, Agent, or Firm*—Norris, McLaughlin & Marcus

(57) ABSTRACT

The present invention includes a method of preparing an inkjet ink imaged lithographic printing plate by imagewise applying an acidic inkjet ink onto a substrate coated with an inkjet ink reactive coating composition which is acid-catalyzed, to produce an imaged coated substrate wherein the inkjet ink imaged regions are more insoluble than non-imaged regions. Then the imaged and non-imaged regions of the imaged coated substrate are contacted with a developer or fountain solution to selectively remove the coating from the soluble non-imaged regions. The present invention also includes an inkjet ink imaged lithographic printing plate which is prepared by the method of the invention.

13 Claims, No Drawings

ACID INKJET IMAGING OF LITHOGRAPHIC PRINTING PLATES

BACKGROUND OF THE INVENTION

1. Field of the Invention

The present invention has to do with a method of preparing an inkjet ink imaged substrate such as a lithographic printing plate. More particularly, the present invention relates to a method of preparing a lithographic printing plate by providing a coated substrate, the coating of which is insolubilized by contact with an acidic medium. Selected portions of the coating are contacted with an acid delivered as an inkjet ink to produce insoluble regions. The remaining soluble regions of the coating may then be removed with a developer or fountain solution on a printing press to produce a lithographic printing plate.

2. Description of the Related Art

Several methods of preparing imaged lithographic printing plates based upon insolubilization of exposed regions are known in the art. The insolubilization can be achieved by a variety of reactions. A number of these methods use inkjet machines to deposit an ink-receptive image onto a hydrophilic substrate.

Published patent application No. U.S. 2003/0007052 A1 describes a method whereby a conventional negative lithographic coating which contains a diazonium condensate coated on a printing plate is selectively coated with alkaline inkjet ink to produce developer-insoluble imaged regions.

U.S. Pat. No. 6,472,054 describes a method of making a ready-to-use printing plate. An inkjet applies an acidic polymer, which is at least partially neutralized with a base, to a substrate. The polymer is dried after which the plate can be used without developing. A similar concept is described in U.S. Pat. No. 5,738,013 wherein an inkjet fluid is employed to apply an oleophilic image to a substrate.

U.S. Pat. No. 5,275,689 describes a method wherein an acid labile polymer is applied to a substrate and an inkjet is used to print a solution of organic acid and solvent thereon. Heat is applied to remove the solvent and then the plate is developed by washing away the solubilized acid labile polymer.

None of the related art discloses a method in which an acid delivered as an inkjet ink is employed to cross-link printed portions of a substrate to produce the inkjet ink imaged lithographic printing plates of the present invention.

Accordingly, it is an object of the present invention to provide a simple method of preparing a lithographic printing plate using commercial inkjet printers.

SUMMARY OF THE INVENTION

The present invention includes a method of preparing an inkjet ink imaged lithographic printing plate, comprising the steps of:

imagewise applying an acidic inkjet ink onto a substrate coated with a soluble admixture which cross-links or insolubilizes in the presence of an acid to produce an imaged coated substrate wherein the inkjet ink imaged regions are cross-linked or insolubilized and the non-imaged regions remain soluble (Heating of the inkjet imaged, coated substrate may be necessary to cause the cross-linking or insolubilization.); and contacting the imaged and non-imaged regions of the imaged coated substrate and a suitable developer, or fountain solution to selectively remove the soluble coating from the non-imaged regions.

The present invention further includes a method of preparing an inkjet imaged lithographic printing plate, comprising the steps of:

applying onto a substrate a soluble acid inkjet ink reactive coating composition, which can be insolubilized by the acid of an inkjet ink, to produce a coated substrate;

applying onto the coated substrate an acid inkjet ink image to produce, after a sufficient time at a sufficient temperature, an imaged coated substrate having insoluble imaged regions and soluble non-imaged regions; and contacting the imaged and non-imaged regions of the imaged coated substrate with a developer or fountain solution to selectively remove the coating from the soluble non-imaged regions and produce the inkjet ink imaged lithographic printing plate.

The present invention still further includes a method of preparing an acid inkjet ink imaged lithographic printing plate, comprising the steps of:

imagewise applying onto a substrate coated with an acid inkjet ink reactive coating composition which can be insolubilized by the acid of the inkjet ink to produce, after a sufficient time at a sufficient temperature, an imaged coated substrate having insoluble imaged regions and soluble non-imaged regions; and contacting the imaged and non-imaged regions of the imaged coated substrate and a developer or fountain solution to selectively remove the coating from the soluble non-imaged regions.

The present invention also includes a lithographic printing plate, such as an inkjet ink imaged lithographic printing plate, which is prepared by any of the methods of the present invention.

The invention utilizes inexpensive inkjet technology to apply images digitally. Typical "CTP" (computer-to-plate) digital printing plates are imaged utilizing very expensive laser systems. These laser systems usually cost in excess of $200,000 per unit. The high cost of the laser systems excludes large markets for digital imaging. A large format inkjet plate imager would cost on the order of thousands of dollars, not hundreds of thousands. By reducing the cost obstacle, smaller printers will be able to afford, and take advantage of digital imaging.

The present invention utilizes a pre-sensitized printing plate that has a substantial coating, which is insolubilized by exposure to acid. Only a thin layer of acid is required to "convert" the underlying coating to an insoluble state, rendering the image. Acid insolubilized/hardened coatings suggested in this invention are well known to be the most durable on-press, and capable of running well over 1,000,000 impressions. Presently reported methods of inkjet imaging of printing plates typically produce plates having a significantly shorter length-of-run.

The present invention utilizes inexpensive, commonly available commodity chemicals to prepare an acidic digital inkjet medium. The inexpensive source of acid present in the inkjet replaces the need for very expensive acid progenitors as coating components (such as the trihalomethyl-substituted s-triazines, onium salts, iron arene complexes, nitrobenzyl esters, sulfonic acid esters described in U.S. Pat. No. 5,763,134). Without acid progenitors, which have limited shelf life, the storage life of pre-sensitized printing plates is virtually unlimited.

Acid progenitors and dyes capable of absorbing radiation, which are frequently used in pre-sensitized plate coatings, are difficult to dissolve, and often require the use of hazardous solvents. In the present invention, the use of the inkjet acid allows the elimination of the acid progenitors, and the dyes from the coatings. The resins themselves (novolak, melamine, etc.) are often easily soluble in a variety of "safe" solvents which are not harmful to either people, or the environment.

Typical pre-sensitized plates are damaged when exposed to white light, and require special handling. Ultraviolet, visible light, and infrared laser sensitive plates are all sensitive, in varying degrees, to white light, and must be handled under special conditions. Even though the present invention works with such plates that are based on acid progenitors, the acid progenitors are not necessary. Without the acid progenitors, the plate is not sensitized, and may be handled safely in any light environment.

DETAILED DESCRIPTION OF THE INVENTION

The present invention is most useful in negative-working printing plates.

Lithographic printing plate precursors, i.e., imageable elements, typically include a radiation-sensitive coating applied over the hydrophilic surface of a support material. If after exposure to radiation, the exposed regions of the coating become the ink-receptive image regions, the plate is called a negative-working printing plate. Conversely, if the unexposed regions of the coating become the ink-receptive image regions, the plate is called a positive-working plate.

In the present invention, the imagewise inkjet ink exposed regions are rendered less soluble or less dispersible in a developer or fountain solution, and become the ink-receptive image areas. The unexposed regions, being more readily soluble or dispersible in the developer or fountain solution, are removed in the development process or during roll-up on a printing press, thereby revealing a hydrophilic surface, which readily accepts water and becomes the ink-repellant image area. In each instance, the regions of the radiation-sensitive layer that remain (i.e., the image areas) are ink-receptive and the regions of the hydrophilic surface revealed by the developing process accept water and not ink.

In the method of preparing an inkjet ink imaged lithographic printing plate according to the present invention, the first step is applying an acidic inkjet ink reactive coating composition onto a substrate to produce a substrate that is coated with the acidic inkjet ink reactive composition. The acidic inkjet ink reactive composition may comprise a phenolic or novolak resin admixed with a melamine derivative, the cross-linking of which is acid-catalyzed, and which can be insolubilized by an inkjet ink which comprises an acid, followed by heating. Any type of acid can be employed although the optimum acid strength (pH) will vary depending on the acid used and the nature of the acidic inkjet ink reactive coating composition. Preferred acids include organic acids such as oxalic acid, tartaric acid, gluconic acid, lactic acid, diphenyl sulfonate derivatives, alkyl aryl sulfonates, etc., polymeric acids such as polyvinyl phosphonic acid and inorganic acids such as phosphoric acid, sulfuric acid and hydrochloric acid.

The inkjet ink reactive composition may include optional ingredients such as binder materials, surfactants, stabilizers and colorants.

A person of ordinary skill in the art would know how to use other compositions that will cross-link and become insoluble upon application of an acidic inkjet ink.

The inkjet ink reactive coating composition is applied onto a lithographic substrate, such as, an aluminum sheet, polyester or paper. The aluminum sheet is preferably prepared by a method, such as, degreasing; mechanically, chemically, or electrochemically roughening or a combination thereof; optionally etching; anodizing; and optionally treating with an adhesion modifier such as polyvinyl phosphonic acid or silicate or other compositions known in the art. This optional treatment is sometimes referred to in the art as deposition of an interlayer and other compositions that can be used to deposit an interlayer include organic carboxylic acids, organic phosphonic acids, organic sulfonic acids and salts thereof. Of these acids and salts, organic carboxylic acids and the salts thereof are preferred over the others. Examples of such organic carboxylic acids and salts thereof include aliphatic monocarboxylic acids, such as formic acid, acetic acid, propionic acid, butyric acid, lauric acid, palmitic acid and stearic acid; unsaturated aliphatic monocarboxylic acids, such as oleic acid and linolic acid; aliphatic dicarboxylic acids, such as oxalic acid, succinic acid, adipic acid and maleic acid; oxycarboxylic acids, such as lactic acid, gluconic acid, malic acid, tartaric acid and citric acid; aromatic carboxylic acids, such as benzoic acid, mandelic acid, salicylic acid and phthalic acid; and the group Ia, IIb, IIIb, IVa, VIb and VIII metal salts and ammonium salts of the acids as described above. Of these salts of organic carboxylic acids, the above-described metal or ammonium salts of formic acid, acetic acid, butyric acid, propionic acid, lauric acid, oleic acid, succinic acid and benzoic acid are preferred over the others. Examples of organic phosphonic and related acids include substituted or unsubstituted phenylphosphonic acids, naphthylphosphonic acids, alkylphosphonic acids, glycerophosphonic acids, methylenediphosphonic acids and ethylenediphosphonic acids; organic phosphoric acids, such as unsubstituted or substituted phenylphosphoric acids, naphthylphosphoric acids, alkylphosphoric acids and glycerophosphoric acids; organic phosphinic acids, such as unsubstituted or substituted phenylphosphinic acids, naphthylphosphinic acids, alkylphosphinic acids and glycerophosphinic acids. Other examples of suitable acids include amino acids, such as glycine, β-alanine, valine, serine, threonine, asparaginic acid, glutamic acid, arginine, lysine, tryptophan, parahydroxyphenylglycine, dihydroxyethylglycine and anthranilic acid; aminosulfonic acids, such as sulfaminic acid and cyclohexylsulfaminic acid; and aminophosphonic acids, such as 1-aminomethylphosphonic acid, 1-dimethylaminoethyl-phosphonic acid, 2-aminoethylphosphonic acid, 2-aminopropylphosphonic acid, 4-aminophenylphosphonic acid, 1-aminoethane-1,1-diphosphonic acid, 1-amino-1-phenylmethane-1,1-diphosphonic acid, 1-dimethylaminoethane-1,1-diphosphonic acid, 1-dimethylaminobutane-1,1-diphosphonic acid and ethylenediaminetetramethylenephosphonic acid. Further, the salts formed from acids, such as hydrochloric acid, sulfuric acid, nitric acid, sulfonic acid (e.g., methanesulfonic acid) and oxalic acid, and bases, such as alkali metals, ammonia, lower alkanolamines (e.g., triethanolamine) and lower alkylamines (e.g., triethylamine), can be used. In addition, water-soluble polymers are also used advantageously. Examples thereof, include polyacrylamide, polyvinyl alcohol, polyvinyl pyrrolidone, polyethyleneimine and mineral acid salts thereof, poly(meth)acrylic acid and metal salts thereof, polystyrenesulfonic acid and metal salts thereof, alkyl(meth)acrylate/2-acrylamide-2-methyl-1-propanesulfonic acid copolymers and metal salts thereof, chlorotrialkylammonium methylstyrene polymers and chlorotrialkylammonium methylstyrene/(meth)acrylic acid copolymers. Further, soluble silicates such as sodium silicate and others well known in the art can be used. Soluble starch, carboxymethyl cellulose, dextrin, hydroxyethyl cellulose, gum Arabic, guar gum, sodium alginate, gelatin, glucose and sorbitol can be used too. All of these compounds may be used alone or as mixtures of two or more thereof. In treatment with these compounds, it is appropriate that they be dissolved in water, methyl alcohol or a mixture thereof so as to have a concentration of 0.001 to 10 weight %, preferably 0.01 to 1.0 weight %. As to suitable conditions for the treatment, the treatment temperature is from 25 to 95° C., preferably from 50 to 95° C., the pH of the solution is from 1 to 13, preferably 2 to 10, and the immersion time is from 10 seconds to 20 minutes, preferably 10 seconds to 3 minutes.

In the second step of the method of the present invention, after coating the substrate, an acidic inkjet ink image is applied onto the coated substrate. After a sufficient time at a sufficient temperature, the reaction between the inkjet ink reactive composition and acidic ink is substantially complete. Typically, the time needed for a substantially complete cross-linking reaction is from about 1 second to about 30 minutes, preferably from about 15 to about 60 seconds, at a temperature from about 10° C. to about 250° C., preferably from about room temperature to about 150° C. Accordingly, after applying the acidic inkjet ink onto the coated substrate, about 1 second to about 30 minutes is allowed to expire before application of the developer.

After a substantially complete cross-linking reaction, a coated substrate having developer-insoluble imaged regions and developer-soluble non-imaged regions is produced.

The amount of acid in the inkjet ink composition should be sufficient to cause a substantial change in the solubility of the inkjet ink reactive composition. The optimal amount depends on the inkjet droplet volume, equivalent weight and the coating thickness of the inkjet ink reactive coating.

The acidic inkjet ink composition may also include water-miscible organic solvents that can swell the inkjet ink reactive composition and thereby help the acid from the ink to penetrate into the inkjet ink reactive composition. Exemplary water-miscible organic solvents are N,N-dimethylformamide, N,N-dimethyl acetamide, N-methylpyrrolidinone, methyl lactate, ethyl lactate, phenoxy ethanol benzyl alcohol, and butoxy ethanol. Some of these solvents are miscible with water only in the presence of surfactants.

In the third step of the method of the present invention, after the acidic inkjet ink image is applied onto the coated substrate, heat is applied and the phenolic or novolak resin is allowed to react, the imaged and non-imaged regions of the coated substrate and a developer or a fountain solution are contacted.

The pH of the aqueous developer is preferably from about 7 to about 14, depending on the nature of the coating composition, and more preferably between 10 and 13.

The developer is preferably an aqueous alkali developer, such as those commonly used in lithography. Common components of aqueous developers include surfactants, chelating agents, such as salts of ethylenediamine tetraacetic acid, organic solvents, such as benzyl alcohol, and alkaline components, such as, inorganic metasilicates, organic metasilicates, hydroxides and bicarbonates.

The step of contacting described above selectively removes the coating from the non-imaged regions, which are developer-soluble, along with any unreacted ink from the imaged regions. This step is achieved without removing the imaged regions, which are insolubilized.

Thus, the imaged regions, which are insolubilized, produce an inkjet ink imaged lithographic printing plate in which the insolubilized regions become the ink recipient regions during printing.

The method of the present invention further includes an optional post curing step of the developer-insoluble imaged regions after the water wash step. Post curing can be used to increase press life. The post curing can be carried out by exposing the imaged and non-imaged regions to heat, actinic radiation, or a combination of heat and actinic radiation, such as, ultraviolet radiation, at an ambient or super-ambient temperature. The step of exposing to heat is typically carried out for a period of time from about 1 second to about 30 minutes at a temperature about 100° C. to about 250° C.

One of the advantages of the present method is that post curing of the developer-insoluble imaged regions can be carried out after removing the developer-soluble imaged regions.

The present invention is useful in lithographic plate-making, especially in print shops where it is desirable to implement low-capital computer-to-plate work-flows.

EXAMPLES

The following examples are provided to illustrate the invention and are not intended to limit its scope.

Example I

A Viper™ pre-sensitized CTP printing plate (available from Southern Lithoplate, Inc., P.O. Box 9400, Wake Forrest, N.C. 27588-9400 USA) was imagewise exposed to 830 nanometer infrared laser in a CREO™ Trendsetter News laser imaging system. The laser power was varied from 11 to 24 watts. Full image conversion was established at 17 watts.

Example II

A pH 2.4 solution of 2.5% polyvinyl acetate, 2.5% lactic acid, and 0.5% amino tris(methylenephosphonic acid) in de-ionized water, was imagewise applied to a Viper™ pre-sensitized CTP printing plate, from Southern Lithoplate, via microdroplets. The microdroplet imaged plate was further exposed to heat (285 degrees Fahrenheit) for 30 seconds, and then developed in Viper™ 830N CTP Developer. Areas of the coated Viper™ plate that were imagewise exposed to the acidic solution were insoluble, and were not removed in development. Areas that were not imagewise exposed to the acidic solution were soluble, and removed by the developer. The resulting image density and chemical resistance were the same as the laser imaged plate in example 1 at 17 watts.

Example III

The solution from Example II was adjusted to a pH of 3.0. After heating, and developing, there was partial image conversion. The image density was 75% less than Example II.

Example IV

A solution of 2% polyvinylphosphonic acid in de-ionized water was imagewise applied to a Spectratech Viper™ CTP pres-sensitized printing plate. The plate was further heated at 285 degrees Fahrenheit, and developed in Spectratech 830N Developer. Regions which were exposed to the acid were rendered insoluble to the developer. Regions which were not exposed to the acidic inkjet were soluble in the developer, and washed away.

Example V

A solution of 2% para-toluene sulfonic acid in de-ionized water was imagewise applied to a thermal CTP plate, as in Examples II, III, and IV. The results were similar with regard to solubility differentials created by the exposure to the acidic inkjet medium.

Example VI

Solutions of inorganic acids were prepared, and imagewise applied to thermal CTP plates as in Examples II, III, IV and V. The inorganic acids employed were:

Hydrochloric Acid
Sulfuric Acid
Nitric Acid
Phosphoric Acid

Depending on the pH, the results in creating images were similar to those of the referenced Examples.

Example VII

A coating of 90% by weight Schenetady International CRJ406 (novolak resin), and a 10% by weight Cymel 300 (melamine derivative cross-linking agent) was dissolved in n-methylpyrrolidone at a concentration of 10%. It was applied to a grained, anodized aluminum substrate and dried. An acidic inkjet solution was imagewise applied to the coated substrate, then it was heated at 285 degrees Fahrenheit for 30 seconds, and developed in Southern Lithoplate 830n developer. Regions of novolak/melamine coating that had been imagewise exposed to the acid inkjet solution were insoluble to the developer. Regions that were not exposed to the developer for the novolak/melamine coating were soluble and washed away, rendering an oleophylic image, and a hydrophilic non-image suitable for a printing plate.

Example VIII

Comparison of Laser Imaged to Acid Inkjet Imaged Viper[tm] Printing Plate

| | Image Loss/Rub Resistance | | | |
|---|---|---|---|---|
| | 10 Rubs | 15 Rubs | 20 Rubs | 25 Rubs |
| Laser Power | | | | |
| 17 watts | 18.6% | 28.6% | 38.4% | 75.1% |
| 20 | 11.4 | 22.2 | 26.8 | 40.5 |
| 23 | 5.1 | 10.5 | 15.7 | 24.6 |
| Ink pH | | | | |
| 3.7 | 34.2 | 47.2 | 74.2 | 86.9 |
| 3.1 | 2.6 | 5.9 | 12.8 | 39.2 |

The image loss is measured by optical densitometer after a specific number of rubs with an image removing pen.

The acid utilized in this inkjet formulation was dodecylbenzene disulfonic acid at 10%. The pH was adjusted using sodium hydroxide.

The data indicates that the rub resistance of the image created utilizing the acid at pH 3.1 is superior to laser imaging, even up to 23 watts. Normal laser power levels required to properly image a plate vary from system to system. On the unit employed for this comparison, complete image reproduction is normally achieved at 19 watts.

What is claimed is:

1. A method of preparing an inkjet ink imaged lithographic printing plate, comprising the steps of:

imagewise applying an acidic inkjet ink onto a substrate coated with an acidic inkjet ink reactive coating composition which is acid-catalyzed to produce an imaged coated substrate, wherein the inkjet ink imaged regions are more insoluble than non-imaged regions which are developer soluble; and contacting said imaged and non-imaged regions of said imaged coated substrate and a developer or a fountain solution to selectively remove said coating from said developer-soluble non-imaged regions.

2. The method of claim 1 wherein the developer is aqueous.

3. The method of claim, 1 wherein said substrate is a lithographic substrate made of material selected from the group consisting of aluminum, polyester and paper.

4. The method of claim 3, wherein said lithographic substrate is an aluminum sheet.

5. The method of claim 4, wherein said aluminum sheet is prepared by the sequential steps of degreasing; mechanical, chemical or electrochemical roughening, or a combination thereof; optionally etching; anodizing; and optionally, treating with polyvinyl phosphonic acid or silicate.

6. The method of claim 1, further comprising:

post curing said inkjet ink imaged lithographic printing plate.

7. The method of claim 6, wherein said post curing is carried out by a process comprising exposing said lithographic printing plate to heat, actinic radiation, or a combination thereof.

8. The method of claim 7, wherein said actinic radiation is ultraviolet radiation.

9. The method of claim 7, wherein said exposing to heat is carried out at an ambient or super-ambient temperature.

10. The method of claim 7, wherein said exposing to heat is carried out for a period of time from about 1 second to about 30 minutes.

11. The method of claim 6, wherein said post curing of said insoluble imaged regions is carried out after removing said soluble imaged regions.

12. A method of preparing an inkjet ink imaged lithographic printing plate, comprising the steps of:

applying onto a substrate an inkjet ink reactive coating composition, which can be insolubilized by an acidic inkjet ink, to produce a coated substrate;

applying onto said coated substrate an acidic inkjet ink image to produce, after a sufficient time at a sufficient temperature, an imaged coated substrate having insoluble imaged regions and soluble non-imaged regions; and contacting said imaged and non-imaged regions of said imaged coated substrate and a developer or fountain solution to selectively remove said coating from said soluble non-imaged regions and produce said inkjet ink imaged lithographic printing plate.

13. A method of preparing an inkjet ink imaged lithographic printing plate, comprising the steps of:

imagewise applying an acidic inkjet ink onto a substrate coated with an inkjet ink reactive coating composition comprising a phenolic or novolak resin admixed with a melamine derivative, the cross-linking of which is acid-catalyzed and which can be insolubilized by the acid of said inkjet ink, to produce, after a sufficient time at a sufficient temperature, an imaged coated substrate having insoluble imaged regions and soluble non-imaged regions; and contacting said imaged and non-imaged regions of said imaged coated substrate and a developer to selectively remove said coating from said soluble non-imaged regions.

* * * * *